US010201199B2

(12) United States Patent
Ragan

(10) Patent No.: US 10,201,199 B2
(45) Date of Patent: Feb. 12, 2019

(54) GLOVE FINGER ATTACHMENT SYSTEM

(71) Applicant: SHELBY GROUP INTERNATIONAL, INC., Collierville, TN (US)

(72) Inventor: Thomas G. Ragan, Collierville, TN (US)

(73) Assignee: SHELBY GROUP INTERNATIONAL, INC., Collierville, TN (US)

( * ) Notice: Subject to any disclaimer, the term of this patent is extended or adjusted under 35 U.S.C. 154(b) by 0 days.

(21) Appl. No.: 16/035,004

(22) Filed: Jul. 13, 2018

(65) Prior Publication Data

US 2018/0317576 A1 Nov. 8, 2018

Related U.S. Application Data

(63) Continuation of application No. 15/408,252, filed on Jan. 17, 2017, now Pat. No. 10,021,924, which is a continuation of application No. 14/792,254, filed on Jul. 6, 2015, now Pat. No. 9,549,578, which is a continuation of application No. 13/599,887, filed on Aug. 30, 2012, now Pat. No. 9,072,325.

(51) Int. Cl.
*A41D 19/00* (2006.01)
*A41D 19/015* (2006.01)

(52) U.S. Cl.
CPC ..... *A41D 19/0006* (2013.01); *A41D 19/015* (2013.01); *A41D 19/01505* (2013.01)

(58) Field of Classification Search
CPC ..... A41D 19/0006; A41D 19/015; A41D 19/01505
See application file for complete search history.

(56) References Cited

U.S. PATENT DOCUMENTS

| | | | |
|---|---|---|---|
| 211,614 | A | 1/1879 | Allerton |
| 1,252,900 | A | 1/1918 | Grinnell |
| 2,004,382 | A | 6/1935 | Palicki |

(Continued)

FOREIGN PATENT DOCUMENTS

| | | |
|---|---|---|
| DE | 3922598 | 1/1991 |
| FR | 2215179 | 8/1974 |

(Continued)

OTHER PUBLICATIONS

Non-Final Office Action dated May 19, 2014 from U.S. Appl. No. 13/599,887. (17 pages).

(Continued)

*Primary Examiner* — Richale Quinn
(74) *Attorney, Agent, or Firm* — Neal, Gerber & Eisenberg LLP; Thomas E. Williams

(57) ABSTRACT

A glove apparatus is disclosed comprising a substantially glove-shaped first layer, a substantially glove-shaped second layer, and an attachment tab comprising a lower portion, an upper portion, and an extension portion. The attachment tab is attached to a finger portion of the second layer along the lower portion and along the upper portion. The extension portion extends from the attachment tab at a location distal from a fingertip of the second layer and overlies the upper portion to an attachment region on the first layer proximate a fingertip of the first layer, the fingertips of the first layer and of the second layer thereby lying substantially near or in contact with one another.

20 Claims, 6 Drawing Sheets

(56) References Cited

U.S. PATENT DOCUMENTS

| | | | |
|---|---|---|---|
| 2,072,541 | A | 3/1937 | Burnham |
| 2,194,934 | A | 3/1940 | Geissmann |
| 2,446,921 | A | 8/1948 | Grant |
| 2,561,891 | A | 7/1951 | Tucker |
| 2,578,188 | A | 12/1951 | Ionides et al. |
| 3,014,980 | A | 12/1961 | Marshall et al. |
| 3,098,237 | A | 7/1963 | Slimovitz |
| 3,114,915 | A | 12/1963 | Gross |
| 3,625,790 | A | 12/1971 | Ayres |
| 3,869,726 | A | 3/1975 | Bell |
| 3,879,764 | A | 4/1975 | Weber-Liel |
| 4,194,041 | A | 3/1980 | Allen et al. |
| 4,197,592 | A | 4/1980 | Klein |
| 4,209,857 | A | 7/1980 | Clark, Jr. et al. |
| 4,355,424 | A | 10/1982 | Mccoy, Jr. |
| 4,370,365 | A | 1/1983 | Takamizawa et al. |
| 4,430,759 | A | 2/1984 | Jackrel |
| 4,433,439 | A | 2/1984 | Sidman et al. |
| 4,454,611 | A | 6/1984 | Tschirch et al. |
| 4,520,056 | A | 5/1985 | Jackrel |
| 4,545,841 | A | 10/1985 | Jackrel |
| 4,559,646 | A | 12/1985 | Ertl |
| 4,583,248 | A | 4/1986 | Edwards et al. |
| 4,679,257 | A | 7/1987 | Town |
| 4,733,413 | A | 3/1988 | Dykstra |
| 4,847,918 | A | 7/1989 | Sturm |
| 4,918,756 | A | 4/1990 | Grilliot et al. |
| 5,020,161 | A | 6/1991 | Lewis, Jr. et al. |
| 5,020,162 | A | 6/1991 | Kersten et al. |
| 5,088,124 | A | 2/1992 | Dutchik |
| 5,123,119 | A | 6/1992 | Dube |
| 5,153,055 | A | 10/1992 | Ko |
| 5,349,705 | A | 9/1994 | Ragan |
| 5,361,415 | A | 11/1994 | Deering et al. |
| 5,560,044 | A | 10/1996 | Masley |
| 5,566,405 | A | 10/1996 | Masley |
| 5,569,507 | A | 10/1996 | Goodwin et al. |
| 5,598,582 | A | 2/1997 | Andrews et al. |
| 5,603,119 | A | 2/1997 | Rinehart |
| 5,640,718 | A | 6/1997 | Aldridge |
| 5,700,544 | A | 12/1997 | Goodwin et al. |
| 5,732,413 | A | 3/1998 | Williams |
| 5,740,551 | A | 4/1998 | Walker |
| 5,766,400 | A | 6/1998 | Gallagher, Jr. |
| 5,819,316 | A | 10/1998 | Aldridge |
| 5,822,795 | A | 10/1998 | Gold |
| 5,822,796 | A | 10/1998 | Harges, Jr. et al. |
| 5,851,683 | A | 12/1998 | Plamthottam et al. |
| 5,935,882 | A | 8/1999 | Fujita et al. |
| 5,981,019 | A | 11/1999 | Goodwin et al. |
| 6,021,523 | A | 2/2000 | Vero |
| 6,048,810 | A | 4/2000 | Baychar |
| 6,154,886 | A | 12/2000 | Hottner |
| 6,155,084 | A | 12/2000 | Andrews et al. |
| 6,243,875 | B1 | 6/2001 | French |
| 6,591,427 | B1 | 7/2003 | Bennett |
| 6,637,035 | B1 | 10/2003 | Brinkmann et al. |
| 6,718,556 | B2 | 4/2004 | Zuckerwar et al. |
| 6,792,625 | B2 | 9/2004 | Hexels |
| 6,871,359 | B2 | 3/2005 | Han |
| 7,125,816 | B1 | 10/2006 | Baychar |
| 7,225,473 | B2 | 6/2007 | Schierenbeck et al. |
| 7,644,448 | B2 | 1/2010 | Grilliot et al. |
| 7,784,113 | B2 | 8/2010 | Ragan et al. |
| 9,066,545 | B2 | 6/2015 | Klug et al. |
| 9,072,325 | B2 | 7/2015 | Ragan |
| 9,549,578 | B2 | 1/2017 | Ragan |
| 2002/0073474 | A1 | 6/2002 | Geng |
| 2003/0015275 | A1 | 1/2003 | Phillips et al. |
| 2003/0106133 | A1 | 6/2003 | Novak |
| 2004/0098786 | A1 | 5/2004 | Hottner et al. |
| 2006/0117457 | A1 | 6/2006 | Williams et al. |
| 2007/0124849 | A1 | 6/2007 | Williams et al. |
| 2017/0119071 | A1 | 5/2017 | Ragan |

FOREIGN PATENT DOCUMENTS

| | | |
|---|---|---|
| JP | 5153938 | 6/1993 |
| JP | 2004051723 | 2/2004 |

OTHER PUBLICATIONS

Shelby Fire and Rescue Gloves, Barrier Attachment Methods [online], [retrieved on Jun. 26, 2012]. Retrieved from the Internet <URL: http://www.shelbyglove.com/shelby-FDP/index.html>, p. 8.

GLOVE FINGER ATTACHMENT SYSTEM

CROSS REFERENCE

This application is a continuation of U.S. patent application Ser. No. 15/408,252, filed Jan. 17, 2017, which is a continuation of U.S. patent application Ser. No. 14/792,254, filed Jul. 6, 2015, now U.S. Pat. No. 9,549,578, which is a continuation of U.S. patent application Ser. No. 13/599,887, filed Aug. 30, 2012, now U.S. Pat. No. 9,072,325, all of which are entitled "GLOVE FINGER ATTACHMENT SYSTEM," and are incorporated herein by reference in their entirety.

BACKGROUND

This application relates generally to the field of gloves for a wearer's hands, and more particularly, to systems and methods for attaching adjacent layers of a multi-layer glove to one another. For purposes of this disclosure, U.S. Pat. No. 5,349,705 is incorporated by reference herein in its entirety.

The specialized gloves worn by firemen may exhibit a number of characteristics to ensure that they adequately perform in the hazardous environments encountered during use. Such gloves may include a plurality of layers joined together where each layer is constructed to provide a particular performance characteristic group of characteristics, such as breathability, durability, heat resistance, abrasion resistance, and the like. For example, an outermost shell or layer of the glove may be fabricated from a tough, abrasion-resistant and likely heat-resistant material that shields the hand from heat and permits any gripping or grasping that might be required by the wearer. Inside this outer layer, a moisture barrier may be provided to prevent the firefighter's hands and any intervening layers within the glove from being soaked with water or from being contaminated or damaged by potentially dangerous liquids, such as blood, solvents, or other chemical liquids. Alternatively or in addition to the moisture barrier, one or more additional layer may be provided inside the outer layer (and/or inside the moisture barrier, if provided). This layer may be formed from a soft yet heat-resistant material which may provide a degree of padding for the wearer's hand. Multiple-layer gloves are worn by a variety of users in other industries or for purposes other than firefighting where multiple layers may provide additional protection or utility for the wearer or the wearer's hands.

In the past, most of the types of glue used to affix various portions of such multi-layer gloves together may provide inadequate structural integrity after repeated soakings and may therefore permit the layers to separate from one another. In addition, gloves assembled using adhesive over large portions of their surface areas tended to be inherently less compliant than other glove structures. Also, while the tips of the moisture barrier layer and the insulating inner layer may be sewn together, the moisture barrier may be inadvertently punctured in the process thereby destroying the integrity of the moisture barrier.

Moreover, attaching multiple layers of a glove together may create undesirable internal clearance between adjacent layers, and in particular, between adjacent layer surfaces near the fingertips, resulting in increased glove bulk and loss of finger and fingertip dexterity. Such internal clearance arises from conventional attachment mechanisms involving a form of tape that is affixed to both the top and bottom sides (i.e., knuckle side and fingerprint/finger pad side, respectively) near the fingertip of one glove layer, which tape is brought together to form an extension that extends from the fingertip to the adjacent glove layer and attached thereto. Because the extension originates and extends from the fingertip, the length of the extension, therefore, is proportional to the amount of internal clearance formed between the fingertips of the adjacent glove layers.

SUMMARY

A glove apparatus is disclosed comprising a substantially glove-shaped first layer, a substantially glove-shaped second layer, and an attachment tab. The attachment tab comprises a lower portion and an extension portion. The attachment tab is attached to a finger portion of the second layer along the lower portion. The extension portion extends from the attachment tab at a extension point located distally from a fingertip of the second layer. The extension portion overlies the finger portion and is attached to an attachment region on the first layer, the fingertips of the first layer and of the second layer caused thereby to lie substantially near or in contact with one another.

The attachment tab may comprise an adhesive for attaching the lower portion to the second layer. The lower portion may be attached to the second layer on a knuckle side of the finger portion of the second layer. The extension portion may be attached to the attachment region by stitches. The stitches may be positioned along a stitch line of the first layer. The extension portion may be attached to the attachment region proximate a fingertip of the first layer. The extension portion may comprise a length that is longer than a length of an outer portion, the outer portion being defined as a distance between the extension point and the fingertip of the second layer to cause the fingertip of the first layer to be substantially near or in contact with the fingertip of the second layer. The length of the extension portion may vary according to the length of the outer portion.

In another embodiment, a glove apparatus is disclosed comprising a substantially glove-shaped first layer, a substantially glove-shaped second layer, and an attachment tab comprising a lower portion, an upper portion, and an extension portion. The attachment tab is attached to a finger portion of the second layer along the lower portion and along the upper portion. The extension portion extends from the attachment tab at a location distal from a fingertip of the second layer and overlies the upper portion to an attachment region on the first layer proximate a fingertip of the first layer, the fingertips of the first layer and of the second layer thereby lying substantially near or in contact with one another.

The attachment tab may comprise an adhesive for attaching the lower portion and the upper portion to the second layer. The lower portion and the upper portion may be attached to the second layer on a knuckle side of the finger portion of the second layer. The extension portion may be attached to the attachment region by stitches or by an adhesive, and if by stitches, the stitches may be positioned along a perimeter stitch line of the first layer. The upper portion may comprise an upper edge lying proximate to the fingertip of the second layer. The extension portion may comprise a length that is longer than a length of the upper portion to cause the fingertip of the first layer to be substantially near or in contact with the fingertip of the second layer. The length of the extension portion may vary according to the length of the upper portion.

Another embodiment of a glove apparatus is disclosed, comprising a substantially glove-shaped first layer, a substantially glove-shaped second layer, and an attachment tab comprising a lower portion, an upper portion comprising an upper edge, and an extension portion. The attachment tab is attached to a finger portion of the second layer along the lower portion and the upper portion and the upper edge lies in proximity to a fingertip of the second layer. The extension portion extends from the attachment tab and overlies the upper portion to an attachment region on the first layer proximate a fingertip of the first layer, the extension portion substantially minimizing internal clearance between the fingertips of the first layer and of the second layer.

The lower portion and the upper portion may be attached to the second layer by an adhesive. The lower portion and the upper portion may be attached to the second layer on one of a knuckle side or on a fingerprint side of the finger portion of the second layer. The extension portion may comprise a length that is longer than a length of the upper portion to minimize internal clearance between the fingertips of the first layer and of the second layer.

In another embodiment, a glove apparatus is disclosed comprising a substantially glove-shaped outer layer, a substantially glove-shaped inner layer, a substantially glove-shaped moisture barrier layer attached to and overlying the inner layer and inside the outer layer, and an attachment tab comprising a lower portion, an upper portion, and an extension portion. The attachment tab is attached to a finger portion of the moisture barrier layer along the lower portion and along the upper portion. The extension portion extends from the attachment tab at a location distal from a fingertip of the moisture barrier layer and overlies the upper portion to an attachment point on the outer layer proximate a fingertip of the outer layer, the fingertips of the outer layer and of the moisture barrier layer thereby lying substantially near or in contact with one another.

The attachment tab may comprise an adhesive for attaching the lower portion and the upper portion to the moisture barrier layer. The lower portion and the upper portion may be attached to the moisture barrier layer on a knuckle side of the finger portion of the moisture barrier layer. The extension portion is attached to the attachment point by stitches, and the stitches may be positioned along a perimeter stitch line of the outer layer. The upper portion may comprise an upper edge lying proximate to the fingertip of the moisture barrier layer. The extension portion may comprise a length that is longer than a length of the upper portion to cause the fingertip of the outer layer to be substantially near or in contact with the fingertip of the moisture barrier layer. The length of the extension portion may vary according to the length of the upper portion.

DETAILED DESCRIPTION

Figure 1:
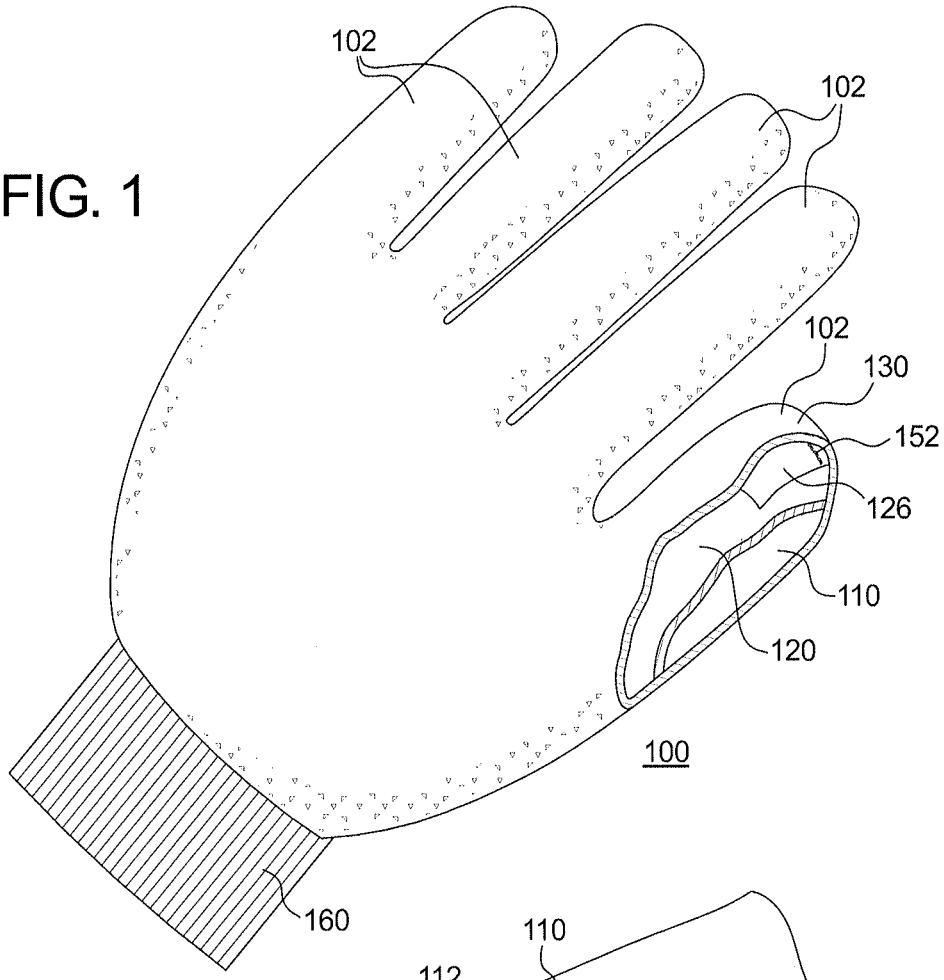
FIG. 1 is a plan view, partially cut away showing an embodiment of a multi-layer glove.

Although the figures and the instant disclosure describe one or more embodiments of a glove attachment apparatus, one of ordinary skill in the art would appreciate that the teachings of the instant disclosure would not be limited to these embodiments.

Turning now to the figures, wherein like reference numerals refer to like elements, there is shown one or more embodiments of a multi-layer glove 100 comprising a glove finger attachment apparatus for connecting adjacent layers of a glove together to avoid internal clearance between the fingertips of one glove layer and the fingertips of an adjacent glove layer.

Referring to FIG. 1, outer layer 130 of glove 100 is shown as having five finger portions 102 including the thumb. However, in certain instances and in alternate embodiments, outer layer 130 of glove 100 may have other numbers of finger portions 102 or none at all like a mitten. It will be understood that reference to a "finger" or a "fingertip" relates to any or all of the digits of any layer of glove 100, and further includes the portion surrounding a wearer's fingers if glove 100 is configured as a mitt. Also, although glove 100 is illustrated as being a left hand glove, it would be appreciated that the instant disclosure is applicable to a right hand glove as well. In one embodiment, glove 100 includes cuff or wristlet 160 attached near the wrist portion of the wearer. In other embodiments, this feature may be deleted, or be replaced by straps, buckles, or other fasteners to help insure a seal of some degree between the wrist or arm of the wearer and glove 100. Those of ordinary skill will appreciate that gloves made in accordance with the disclosure herein can extend for any length down the wearer's arm, from the glove 100 illustrated in FIG. 1, which ends at about the wrist of the wearer, to relatively long gauntlet-styles or other constructions which may integrate a portion of glove 100 with another garment.

As illustrated in the broken away portion of the embodiment of FIG. 1, glove 100 may include inner layer 110 over which may lay moisture barrier layer 120, which may, in turn, be covered by outer layer 130. Outer layer 130 may comprise leather, although canvas or other abrasion resistant materials or any other suitable material that offers the required protection or performance in extreme conditions may be used in other embodiments. Also visible in FIG. 1 is a portion of attachment tab 126 that is usable to connect adjacent layers of glove 100 to one another, as described in further detail below. In particular, attachment tab 126 as configured and positioned as shown and described herein connects adjacent layers of glove 100 together to minimize or eliminate internal clearances between the fingertips of one glove layer and the fingertips of an adjacent glove layer. In this way, overall glove bulk is minimized which causes a shortening of the wearer's finger point-of-contact while improving the dexterity of a wearer's fingers along with the "feel" and gripping ability of the wearer.

Outer layer 130 shown in the figures may comprise multiple pieces stitched together. Outer layer 130 may also include fabric that overlaps other portions of outer layer 130 or which covers other portions of outer layer 130. In one embodiment, a piece of fabric may be stitched over an outer surface of one or more finger portions 102 to provide additional abrasion or wear resistance or protection to a wearer's fingers. In another embodiment, one or more finger portions 102 may comprise multiple sections of fabric stitched or otherwise joined together to form the one or more finger portions 102. For example, the top portion of an index finger portion of outer layer 130 may be stitched to a lower portion of the index finger portion to form a stitch line at or near a knuckle of the wearer to produce a hinge for ease of motion of glove 100 by the wearer. Attachment tab 126, discussed in detail below, may be used to join an adjacent, inner layer to outer layer 130 at any such stitch line of outer layer 130.

Figure 2:
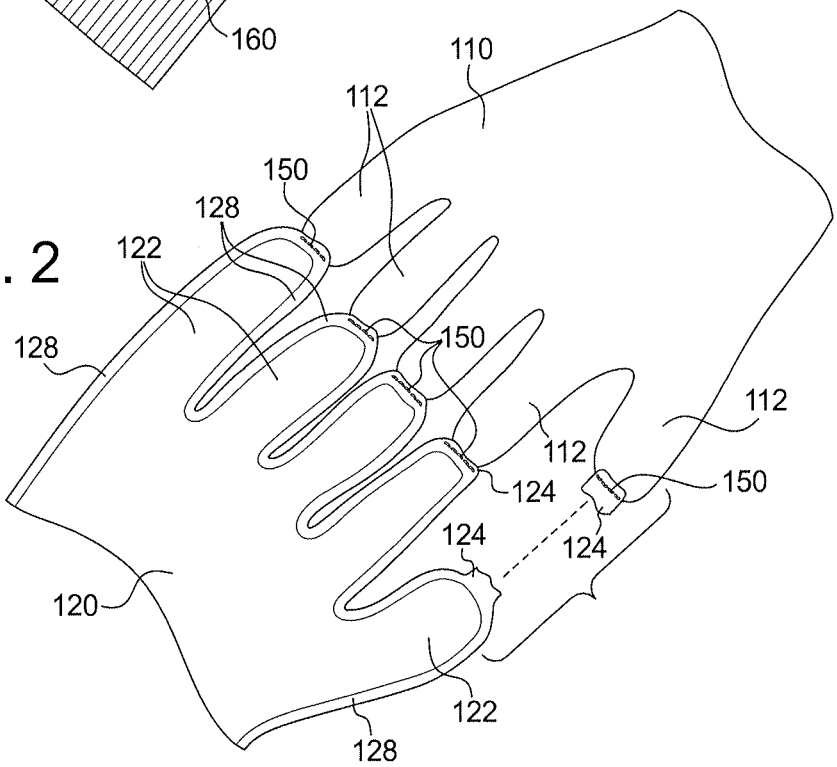
FIG. 2 is a partial perspective view showing an embodiment of a glove finger attachment system for the multi-layer glove of FIG. 1.
Figure 3:
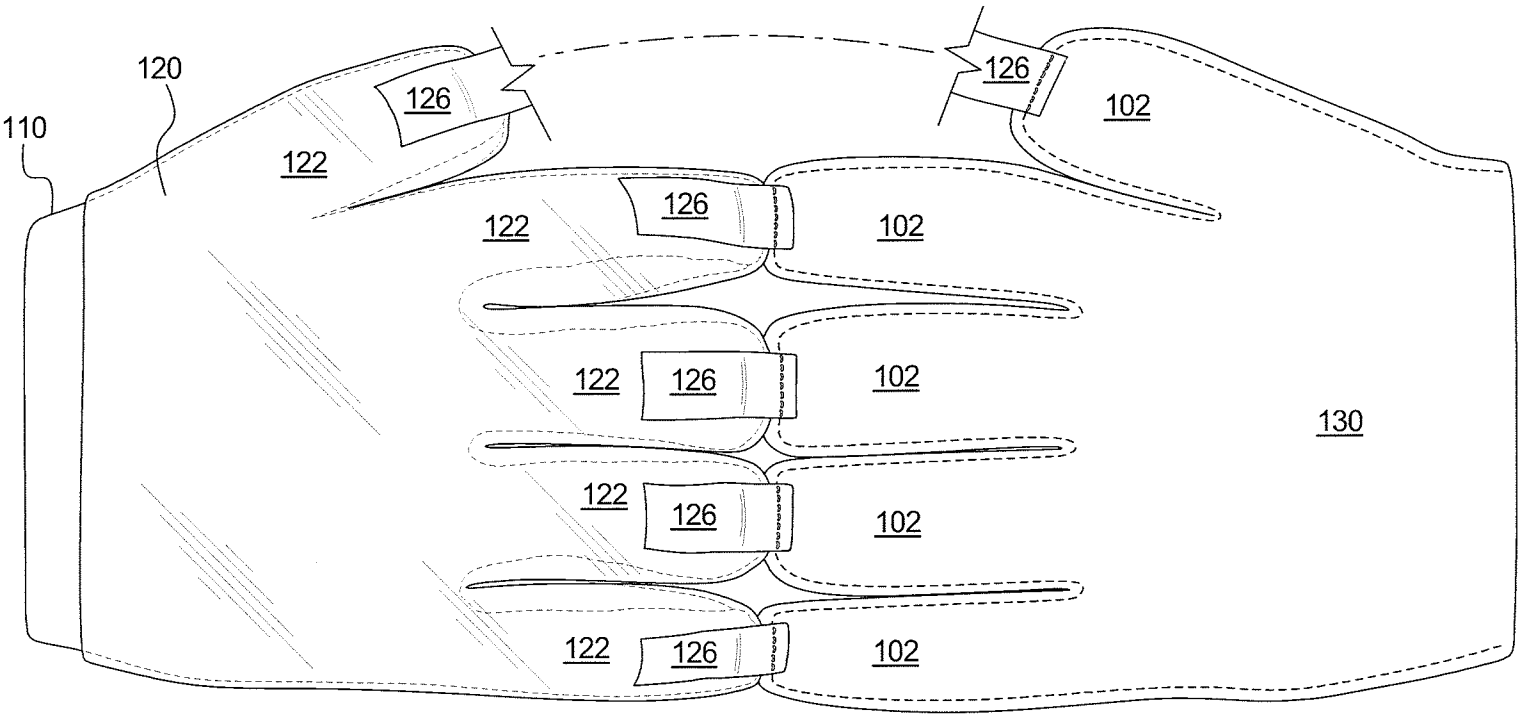
FIG. 3 is a plan view of an embodiment of a finger attachment system for the multi-layer glove of FIG. 1.
Figure 4:
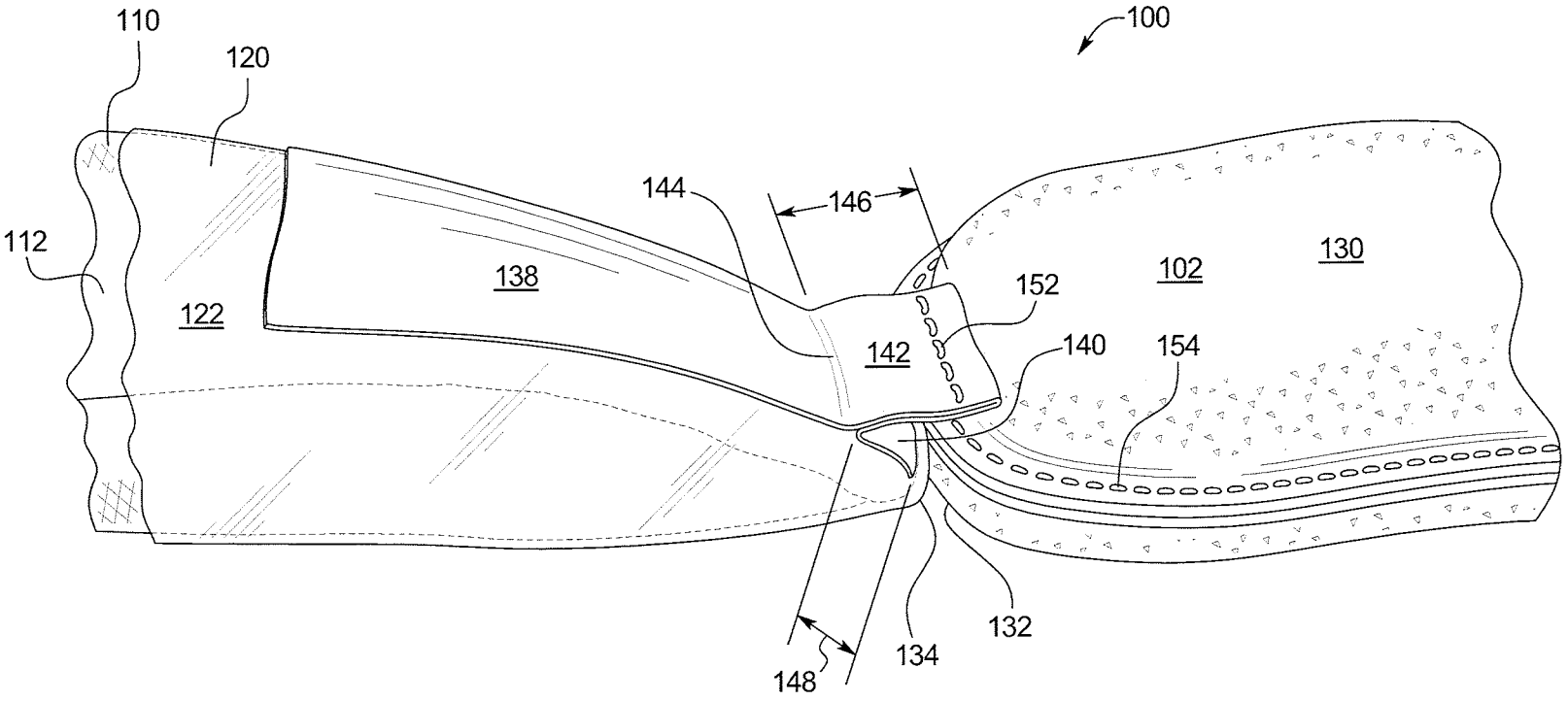
FIG. 4 is a partial perspective view of the embodiment of FIG. 3.

The internal construction of the embodiment of glove 100 illustrated in FIG. 1 can be better explained by referring to FIGS. 2-4 which illustrate both the structure of glove 100 and certain aspects of its assembly. Referring to FIG. 2, inner layer 110 may comprise a knitted or woven material such as wool, polyethylene or any of the numerous known or yet to be developed organic or inorganic fibers, fabrics, or materials suitable for this purpose. Inner layer 110 may comprise a felt-like texture on its inside surfaces and a smooth texture on its outside surfaces. Inner layer 110 may comprise flame resistant or flame retardant properties, such as would result upon the application of flame resistant or flame retardant coatings or thermal protection laminations to inner layer 110. Inner layer 110 may alternatively be formed from flame resistant or flame retardant materials. Inner layer 110 may comprise a laminate or a coating applied or adhered to the outside surfaces to serve as a barrier to moisture, harmful liquids, and/or chemicals.

As is shown in FIG. 2, substantially glove-shaped moisture barrier layer 120 may be provided having a peripheral seal or seam 128 formed about its periphery, including along and around finger portions 122 of moisture barrier layer 120. Peripheral seal 128 may be formed by a heat sealing process. Integrally formed in moisture barrier layer 120 are fingertip extension portions 124 that may act as an extension of that portion of moisture barrier layer 120 that lies beyond peripheral seal 128 of finger portions 122. Inner layer 110 and moisture barrier layer 120 are attached by stitches 150 that pass through fingertip extension portion 124 of moisture barrier layer 120. Stitches 150 passing through fingertip extension portion 124 are thus outside the boundary of peripheral seal 128, leaving the interior portion of the moisture barrier layer 120 unpunctured. Thus, any punctures or damage made to fingertip extension portions 124 or to other similar regions lying outside the sealing edge of peripheral seal 128 do not violate or destroy the moisture resisting capability of moisture barrier layer 120.

Moisture barrier layer 120 may be formed from a material that is completely waterproof, such as a polyethylene, microporous polyether urethane or PTFE (e.g., Teflon™) film or may be formed from a breathable material that is impervious to liquid but permeable to water vapor such that perspiration from the hands may escape through inner layer 110, through moisture barrier layer 120 and ultimately through outer layer 130 to the outside of the glove. In certain embodiments, moisture barrier layer 120 may comprise a chemical treatment applied to a glove layer to cause the layer to resist penetration or transmission of water or vapor therethrough, but which may not truly render the glove layer waterproof or vaporproof. Moisture barrier layer 120 may alternatively, or additionally, comprise thermal protection properties. In certain embodiments, the material chosen for moisture barrier layer 120 may also serve as a barrier to blood or other biohazards, or one or more types of hazardous chemicals, such as caustic solutions, solvents, dyes, industrial wastes and the like. As would be appreciated by one of ordinary skill, certain moisture barrier materials are more resistive to particular classes of hazardous chemicals than others. The choice of a moisture barrier material may depend upon the anticipated types of hazards to which the wearer may be exposed. Thus, as used herein, the term "moisture barrier layer" includes materials that are resistant to one or more types of hazardous liquids, chemicals, viruses, bacteria, and the like. The choice of materials for this layer, and any other layers are design considerations well known to those of ordinary skill depending on the desired cost of the glove, the ultimate anticipated end use and the preference of the wearer.

Referring still to FIG. 2, it will be seen that extension portions 124 are attached to finger portions 112 of inner layer 110 by stitches 150. For purposes of illustration the respective thumb portions of inner layer 110 and moisture barrier layer 120 are shown detached from one another but are connected by a dotted line from extension portion 124 of the thumb of moisture barrier layer 120 to the thumb of inner layer 110. In actuality, according to the embodiment of FIGS. 1-4, all of the respective fingertips, whatever their number may be, of these layers are connected to one another. Moisture barrier layer 120 may then reversed over inner layer 110 to cause it to overlay inner layer 110 to thereby cause stitches 150 to be covered by the sealed portion of moisture barrier layer 120. Inside surfaces of moisture barrier layer 120 may be glued or otherwise adhered to outside surfaces of inner layer 110. In another embodiment, moisture barrier layer 120 may be laminated to and overlay inner layer 110. Alternatively or additionally, moisture barrier layer 120 may be stitched to and overlay inner layer 110 along the perimeter stitch line of inner layer 110.

As shown in FIGS. 3-4, the combined structure of inner layer 110 and moisture barrier layer 120 may be affixed to outer layer 130 by, for example, a second set of stitches 152 to extension portions 142 of attachment tabs 126 along stitch line 154.

As shown in the embodiment of FIG. 4, attachment tab 126 may be configured for attaching moisture barrier layer 120 to outer layer 130. Attachment tab 126 may be affixed to an outer surface of one side, such as a top or knuckle side, of a finger portion 122 of moisture barrier layer 120 by, for example, an adhesive. Attachment tab 126 may alternatively be attached to any other side of finger portion 122, such as the fingerprint/finger pad side of finger portion 122 or one of the opposed sides of finger portion 122. In other embodiments, attachment tab 126 may be affixed to other portions or surfaces of a glove layer, such as moisture barrier layer 120.

Attachment tab 126 may comprise lower portion 138, upper portion 140, and extension portion 142. In one embodiment, attachment tab 126 is attached to moisture barrier layer 120 along lower portion 138 and upper portion 140 while extension portion 142 is attached to outer layer 130. Extension portion 142 is configured to be folded over upper portion 140 and to extend from attachment tab 126 at attachment point 144 positioned distally from fingertip 134 of moisture barrier layer 120 to an attachment point proximate fingertip 132 of inverted outer layer 130, optionally along stitch line 154 of outer layer 130. In another embodiment, attachment tab 126 comprises lower portion 138 and extension portion 142, but no upper portion 140. In this embodiment, extension portion 142 may be configured to extend from attachment tab 126 at attachment point 144 positioned distally from fingertip 134 of moisture barrier layer 120 to an attachment point proximate fingertip 132 of inverted outer layer 130, optionally along stitch line 154 of outer layer 130. In this embodiment, attachment tab 126 may be affixed to moisture barrier layer 120 along lower portion 138 using, for example, an adhesive. In another embodiment, extension portion 142 extends from attachment tab 126 at attachment point 144 to any stitch line on outer layer 130.

Length 146 of extension portion 142 may vary depending on the distance of attachment point 144 on moisture barrier layer 120 relative to fingertip 134 of moisture barrier layer 120. As the distance increases or decreases, which distance is associated with length 148 of upper portion 140, length 146 of extension portion 142 correspondingly increases or decreases. In the embodiment shown in FIG. 4, length 146 is slightly longer than length 148 of upper portion 140 to position stitches 152 at the end of extension portion 142 to cause fingertip 132 of the adjacent outer layer 130 to be substantially near or in contact with fingertip 134 of moisture barrier layer 120 when outer layer 130 is folded over inner layer 110 and moisture barrier layer 120. Said another way, length 146 of extension portion 142 relative to length 148 and relative fingertip 134 of moisture barrier layer 120 minimizes or eliminates internal clearance with fingertip 132 of outer layer 130 to improve the dexterity of a wearer's fingers along with the "feel" and gripping ability of the wearer. In addition, by positioning attachment point 144 distally from fingertip 134 of moisture barrier layer 120, as shown in FIG. 4, length 146 of extension portion 142 provides a needleworker with material from which to manipulate and comfortably separate the adjacent layers to easily stitch, for example, them together using stitches 152 at stitch line 154. In another embodiment, attachment point 144 is positioned distally from fingertip 134 past the approximate location of the wearer's first knuckle. Length 146 in this embodiment would therefore increase to allow the distal end of extension portion 142 to extend to finger portion 102 of outer layer 130 where stitches 152 may be utilized to connect moisture barrier layer 120 to outer layer 130 along, for example, stitch line 154. In another embodiment, stitch line 154 corresponds to a stitch line anywhere on outer layer 130, such as, for example, a stitch line adjoining upper and lower portions of a finger portion 102.

In one embodiment, attachment tab 126 comprises a tape having an adhesive on at least a portion of one side. Attachment tab 126 may alternatively comprise any of a number of materials, such as a fabric or a plastic, affixed to moisture barrier layer 120 either by an adhesive, heat sealing or any other method that permits the material to be attached to moisture barrier layer 120 without puncturing moisture barrier layer 120. The structure illustrated in FIG. 3 is finished by overturning the outer layer 130 so that its outer surface now faces out and its inner surface overlies the moisture barrier layer 120. The completed glove structure may then be affixed to a cuff or wristlet 160, as illustrated in FIG. 1, or as explained above may be affixed to a longer gauntlet portion or to another garment.

In another embodiment to form multi-layer glove 100, moisture barrier layer 120 is first positioned so that extension portions 124 are positioned internally to moisture barrier layer 120. Attachment tab 126 is then affixed using, for example, an adhesive, to the exposed outside surface of moisture barrier layer 120 in the manner explained above. However, in this embodiment, stitches 150 shown in FIG. 2 are sewn through extension portion 142 of attachment tab 126 and through inner layer 110, optionally along the perimeter stitch line of inner layer 110. Moisture barrier layer 120 may then be reversed over inner layer 110 thereby exposing extension portions 124 for connection to outer layer 130. Extension portion 124 may then be attached to inverted outer layer 130 by stitches 152. Finally, outer layer 130 may be reversed over moisture barrier layer 120, resulting in a three-layer glove construction as described above with reference to FIG. 1. Attachment tab 126 may alternatively be affixed using, for example, an adhesive, to the exposed inside surface of outer layer 130. Extension portion 142 may then be folded over upper portion 140 and extended towards and attached to moisture barrier layer 120 via stitches 152 that are positioned along fingertip extension portion 124 so as to not puncture moisture barrier layer 120.

In yet another embodiment, instead of stitching inner layer 110 to fingertip extension portion 124 of moisture barrier layer 120 as described in FIG. 2, attachment tab 126 may be affixed using, for example, an adhesive, to an exposed inside surface of finger portion 122 of moisture barrier layer 120 having no extension portion 124. Extension portion 142 may then be folded over upper portion 140 and extended towards and attached to the exposed outer surface of inner layer 110 via stitches positioned, for example, along the perimeter stitch line of inner layer 110. After reversing moisture barrier layer 120 over inner layer 110, attachment tab 126 may be affixed to an exposed outside surface of finger portion 122 of moisture barrier layer 120 using, for example, an adhesive. Extension portion 142 may then be folded over upper portion 140 and extended towards and attached to the exposed inner surface of finger portion 102 of outer layer 130 and stitched or otherwise affixed thereto as described above.

Figure 5:
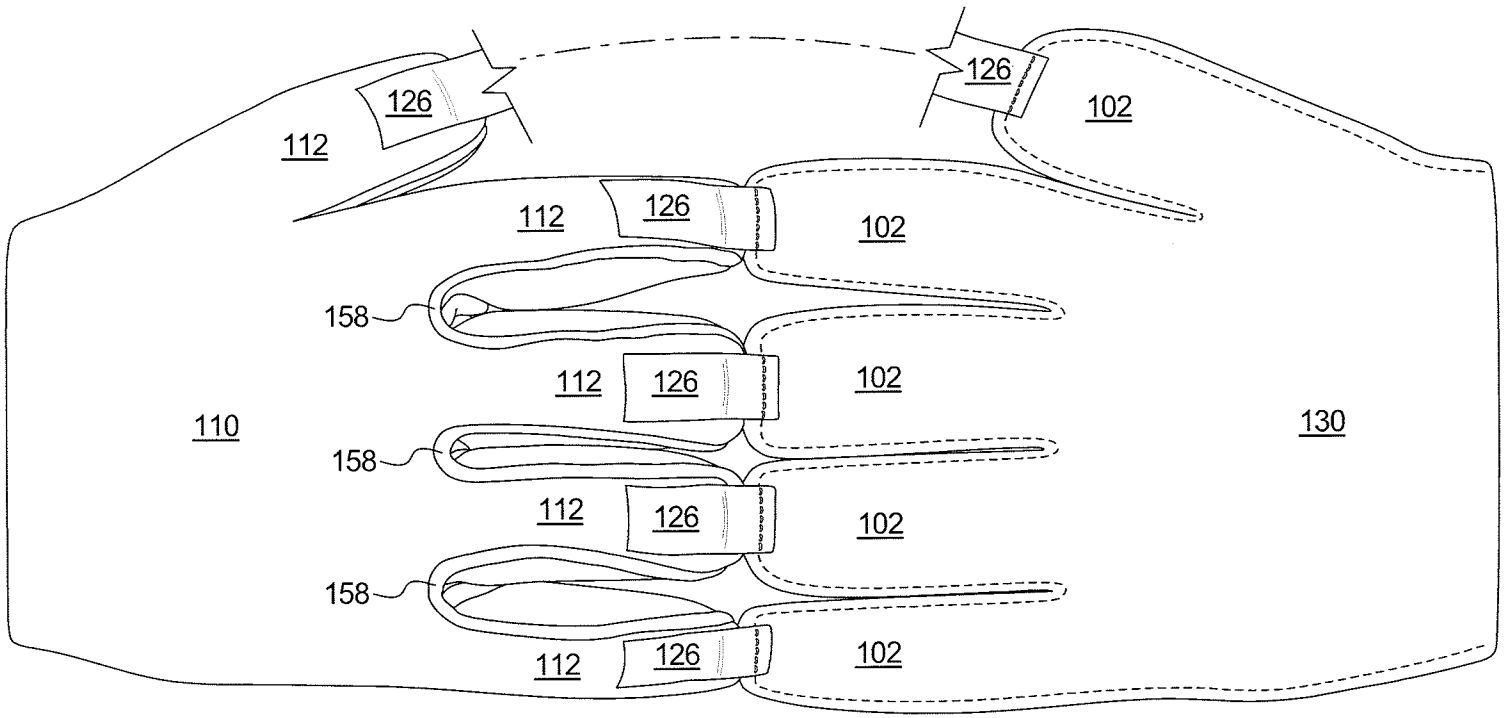
FIG. 5 is a plan view showing another embodiment of a finger attachment system for a multi-layer glove.
Figure 6:
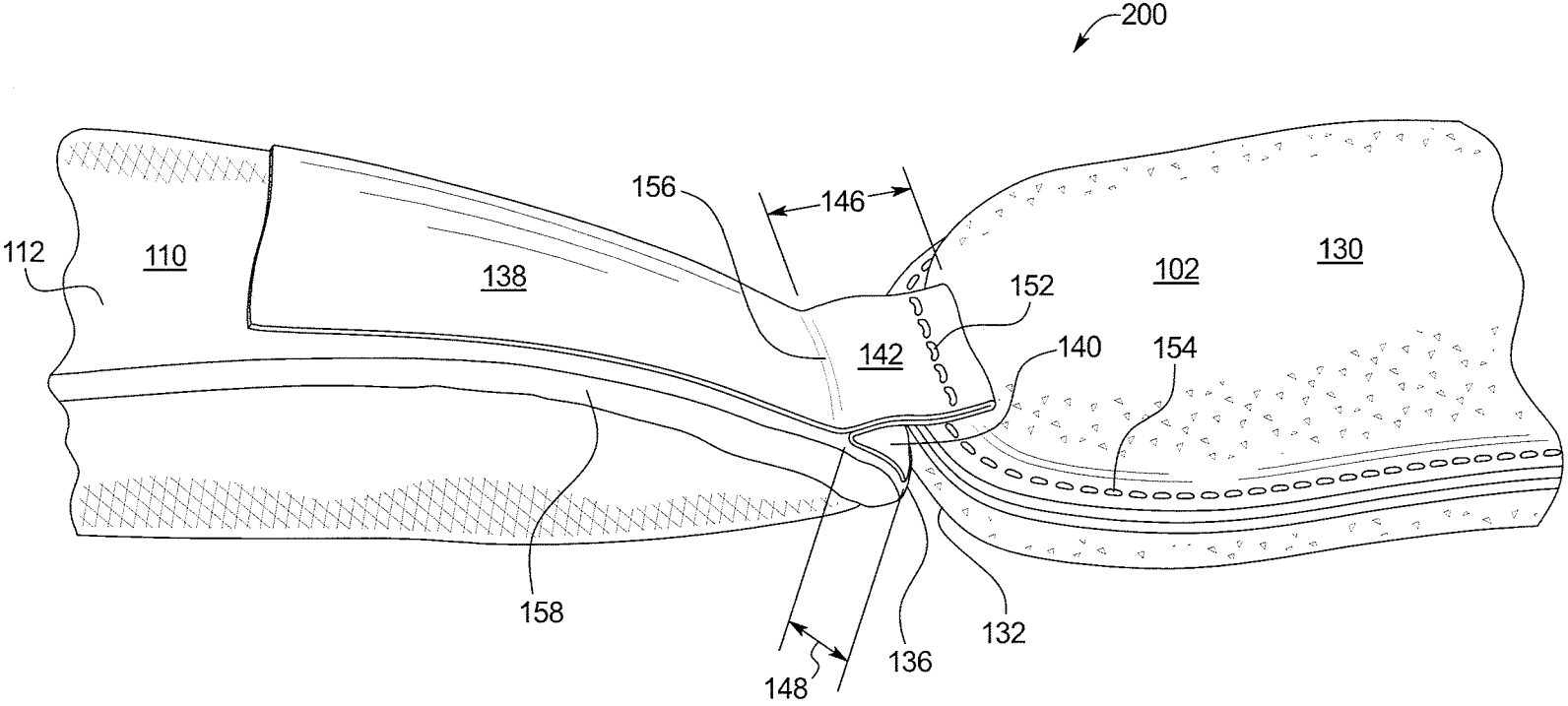
FIG. 6 is a partial perspective view of the embodiment of FIG. 5.

Turning to FIGS. 5-6 there is shown yet another embodiment of a multi-layer glove where inner layer 110 is connected to outer layer 130 to form glove 200 for use in situations where moisture barrier layer 120 is not present or where water/vapor/chemical repellent properties may be integrally incorporated or topically applied to inner layer 110. As shown in FIG. 6, inner layer 110 may comprise sealant 158 along at least the periphery of finger portions 112 and over peripheral stitches of inner layer 110 to provide water/vapor/chemical repellant properties along the seams of inner layer 110. Sealant 158 may comprise any sealant suitable for preventing water/vapor/chemical migration through the stitches. In one embodiment, sealant 158 comprises a primer base of the type disclosed in U.S. Pat. No. 7,784,113, which is incorporated by reference in its entirety herein. Sealant 158 may also comprise an adhesive sealant, such as the type disclosed in U.S. Pat. No. 7,784,113, which adhesive sealant may be applied over the primer base.

As shown in the embodiment of FIG. 5, attachment tab 126 may be affixed to an outer surface of one side, such as a top or knuckle side, of a finger portion 112 of inner layer 110 by, for example, an adhesive. As described above, attachment tab 126 may comprise lower portion 138, upper portion 140, and extension portion 142. Attachment tab 126 is attached to inner layer 110 along lower portion 138 and upper portion 140 while extension portion 142 is attached to outer layer 130. As described above, extension portion 142 is configured to be folded over upper portion 140 and to extend from attachment tab 126 at attachment point 156 positioned distally from fingertip 136 of inner layer 110 to stitch line 154 proximate fingertip 132 of inverted outer layer 130, and optionally along the perimeter stitch line of outer layer 130. Stitches 152 may be utilized to secure inner layer 110 to outer layer 130.

Length 146 of extension portion 142 may vary depending on the distance of attachment point 156 on inner layer 110 relative to fingertip 136 of inner layer 110. As the distance increases or decreases, which distance corresponds to length 148 of upper portion 140, so does length 146 of extension portion 142. Length 146 may be configured to be slightly longer than length 148 of upper portion 140 to position stitch line 154 at the end of extension portion 142 to ensure that fingertip 132 of the adjacent outer layer 130 is caused to be substantially near or in contact with fingertip 136 of inner layer 110 when outer layer 130 is folded over inner layer 110 to form glove 200. The structure illustrated in FIGS. 5-6 is finished by overturning the outer layer 130 so that its outer surface now faces out and its inner surface overlies inner layer 110. The completed glove structure may then be affixed to a cuff or wristlet 160, as illustrated in FIG. 1, or as explained above may be affixed to a longer gauntlet portion or to another garment.

By positioning attachment point 156 distally from fingertip 136 of inner layer 110, as shown in FIG. 6, length 146 of extension portion 142 provides a needleworker with material from which to manipulate and comfortably separate the adjacent layers to easily stitch, for example, them together using stitches 152 at stitch line 154. Said another way, length 146 of extension portion 142 relative to length 148 and relative fingertip 136 of inner layer 110 minimizes or eliminates internal clearance with fingertip 132 of outer layer 130 to improve the dexterity of a wearer's fingers along with the "feel" and gripping ability of the wearer. In addition, by positioning attachment point 156 distally from fingertip 136 of inner layer 110, as shown in FIG. 6, length 146 of extension portion 142 provides a needleworker with material from which to manipulate and comfortably separate the adjacent layers to easily stitch, for example, them together using stitches 152 at stitch line 154.

Figure 7:
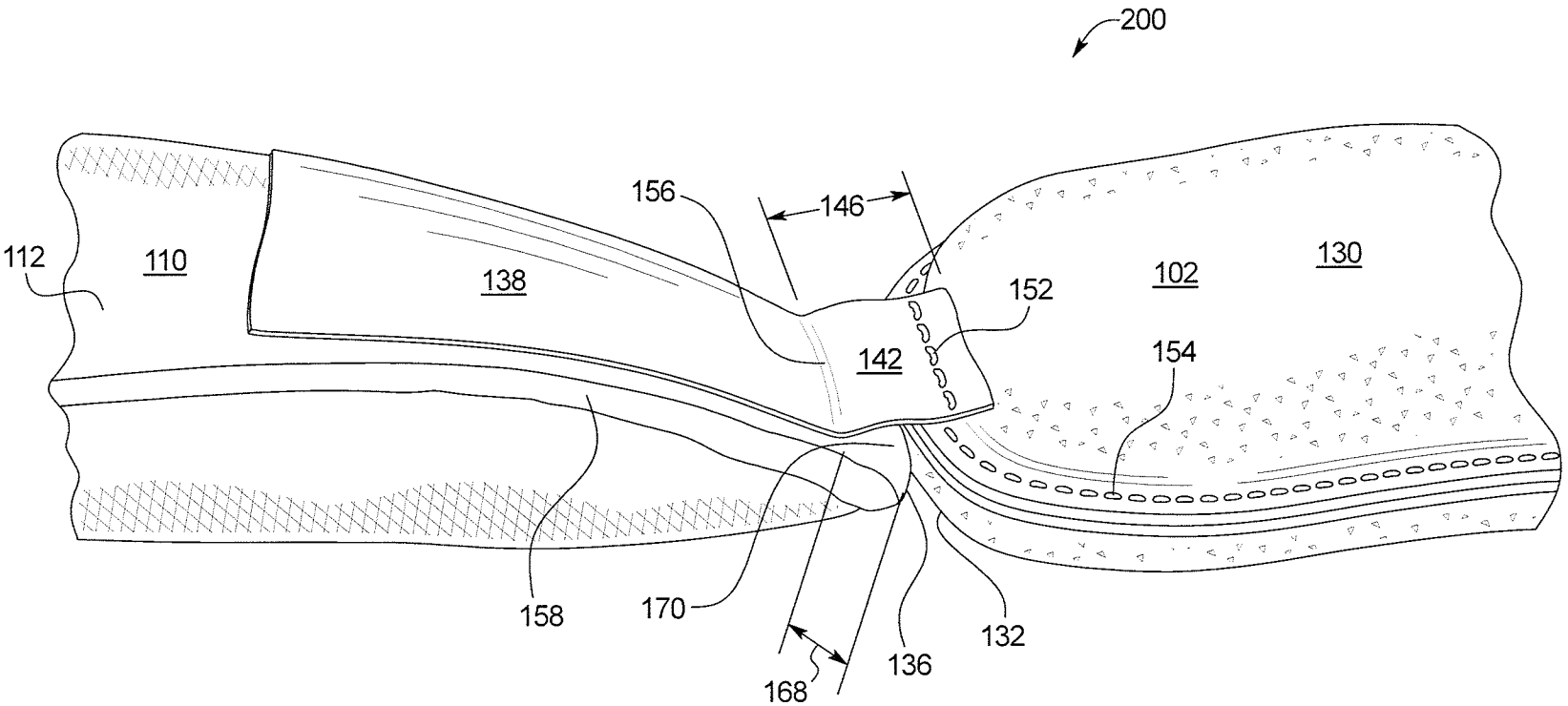
FIG. 7 is a partial perspective view of another embodiment of a finger attachment system for a multi-layer glove.

In another embodiment, as shown in FIG. 7, attachment tab 126 comprises lower portion 138 and extension portion 142, but no upper portion 140. In this embodiment, extension portion 142 may be configured to extend from attachment tab 126 at attachment point 156 positioned distally from fingertip 136 of inner layer 110 to, for example, an attachment point proximate fingertip 132 of inverted outer layer 130, optionally along stitch line 154 of outer layer 130. In this embodiment, attachment tab 126 may be affixed to inner layer 110 along lower portion 138 using, for example, an adhesive. In another embodiment, extension portion 142 extends from attachment tab 126 at attachment point 156 to any stitch line on outer layer 130.

As in other embodiments, length 146 of extension portion 142 may vary depending on the distance of attachment point 156 on inner layer 110 relative to fingertip 136 of inner layer 110. As the distance increases or decreases, which distance corresponds to length 168 of outer portion 170, so does length 146 of extension portion 142. Length 146 may be configured to be slightly longer than length 168 to position stitch line 154 at the end of extension portion 142 to ensure that fingertip 132 of the adjacent outer layer 130 is caused to be substantially near or in contact with fingertip 136 of inner layer 110 when outer layer 130 is folded over inner layer 110 to form glove 200.

While specific embodiments have been described in detail, it will be appreciated by those skilled in the art that various modifications and alternatives to those details could be developed in light of the overall teachings of the disclosure. Accordingly, the disclosure herein is meant to be illustrative only and not limiting as to its scope and should be given the full breadth of the appended claims and any equivalents thereof.

What is claimed is:

1. A glove apparatus, comprising:

an inner glove portion comprising an inner layer comprising a first finger portion; and a barrier layer disposed over and glued to the inner layer, the barrier layer comprising a second finger portion, the second finger portion comprising a proximal end, a distal end opposite the proximal end, and a fingertip at the distal end;

an outer glove portion comprising an outer layer disposed over the inner glove portion, the outer layer comprising a third finger portion; and a coupler connecting the second finger portion to the third finger portion, the coupler connected to the second finger portion by a hinge positioned away from the fingertip between the proximal end and the distal end, the coupler extending from the hinge to the third finger portion, wherein the coupler is not attached to the fingertip.

2. The glove apparatus of claim 1, wherein the coupler comprises a fabric.

3. The glove apparatus of claim 1, wherein the coupler comprises a tape.

4. The glove apparatus of claim 1, wherein the coupler is attached to the second finger portion by an adhesive.

5. The glove apparatus of claim 1, wherein the coupler is attached to the third finger portion by stitches.

6. The glove apparatus of claim 1, wherein the third finger portion is disposed over the second finger portion and the second finger portion is disposed over the first finger portion.

7. The glove apparatus of claim 1, wherein the barrier layer comprises polyethylene.

8. The glove apparatus of claim 1, wherein the inner layer comprises a felt, a fleece, a knitted material, or a woven material, and the outer layer comprises a leather, a canvas, or a fabric.

9. A glove apparatus, comprising:

an inner layer comprising a first finger portion; and a barrier layer disposed over the inner layer, the barrier layer comprising a second finger portion, the second finger portion comprising a proximal end, a distal end opposite the proximal end, and a fingertip at the distal end, the second finger portion further comprising a bottom wall opposite a knuckle-side top wall;

an outer layer disposed over the barrier layer, the outer layer comprising a third finger portion; and a coupler connecting the second finger portion to the third finger portion, the coupler connected to the bottom wall of the second finger portion by a hinge positioned away from the fingertip between the proximal end and the distal end, the coupler extending from the hinge to the third finger portion, wherein the coupler is not attached to the fingertip.

10. The glove apparatus of claim 9, wherein the coupler comprises a fabric or a tape.

11. The glove apparatus of claim 9, wherein the coupler is attached to the second finger portion by an adhesive.

12. The glove apparatus of claim 9, wherein the coupler is attached to the third finger portion by stitches.

13. The glove apparatus of claim 9, wherein the inner layer comprises a felt, a fleece, a knitted material, or a woven material, the barrier layer comprises a moisture resistant material or a waterproof material, and the outer layer comprises a leather, a canvas, or a fabric.

14. The glove apparatus of claim 9, wherein the barrier layer is laminated to, glued to, or stitched to the inner layer.

15. A glove apparatus, comprising:

an inner layer comprising a first finger portion; and a barrier layer disposed over the inner layer, the barrier layer comprising a second finger portion, the second finger portion comprising a proximal end, a distal end opposite the proximal end, and a fingertip at the distal end, the second finger portion further comprising a bottom wall opposite a knuckle-side top wall;

an outer layer disposed over the barrier layer, the outer layer comprising a third finger portion; and a coupler connecting the second finger portion to the third finger portion, the coupler connected to the knuckle-side top wall of the second finger portion by a hinge positioned away from the fingertip between the proximal end and the distal end, the coupler extending from the hinge to the third finger portion, wherein the coupler is not attached to the fingertip.

16. The glove apparatus of claim 15, wherein the coupler comprises a fabric or a tape.

17. The glove apparatus of claim 15, wherein the coupler is attached to the second finger portion by an adhesive.

18. The glove apparatus of claim 15, wherein the coupler is attached to the third finger portion by stitches.

19. The glove apparatus of claim 15, wherein the inner layer comprises a felt, a fleece, a knitted material, or a woven material, the barrier layer comprises a moisture resistant material or a waterproof material, and the outer layer comprises a leather, a canvas, or a fabric.

20. The glove apparatus of claim 15, wherein the barrier layer is laminated to, glued to, or stitched to the inner layer.

* * * * *